United States Patent [19]

Russell

[11] 4,097,084

[45] Jun. 27, 1978

[54] LIFTING GRAB FOR CYLINDRICAL OBJECTS

[75] Inventor: John S. Russell, Pittsfield, Me.

[73] Assignee: Russkraft, Inc., Pittsfield, Me.

[21] Appl. No.: 779,141

[22] Filed: Mar. 18, 1977

[51] Int. Cl.[2] ..... B66C 1/62

[52] U.S. Cl. ..... 294/104; 294/106; 294/110 R; 294/116

[58] Field of Search ..... 294/62, 63 R, 66 R, 294/86 R, 92, 101, 103 R, 104, 106, 110 R, 113, 116

[56] References Cited

U.S. PATENT DOCUMENTS

| | | | |
|---|---|---|---|
| 2,342,506 | 2/1944 | Wrobbel | 294/106 |
| 2,613,103 | 10/1952 | Bushnell | 294/106 |
| 2,655,401 | 10/1953 | Kelso | 294/86 R |
| 3,011,821 | 12/1961 | Doty | 294/104 |
| 3,068,036 | 12/1962 | Doty | 294/104 |
| 3,101,968 | 8/1963 | Cianchette et al. | 294/104 |
| 3,165,347 | 1/1965 | Keskitalo | 294/104 X |
| 3,363,929 | 1/1968 | Nelson | 294/106 X |
| 3,479,078 | 11/1969 | Doty | 294/104 |
| 4,026,593 | 5/1977 | Brown et al. | 294/110 R X |

*Primary Examiner*—Johnny D. Cherry
*Attorney, Agent, or Firm*—Laurence R. Brown

[57] ABSTRACT

A lifting grab is designed to enter restricted areas close to the circumferential diameter of a cylindrical object resting on its bottom such as a pipe or torpedo and to engage a position grasping the object on its circumferential outer surface below its horizontal diameter for lifting the object upwardly. The grab has pivoted hook and clamp members closely surrounding the outer circumference of the object about an arc greater than half the circumferential span, with the clamp member terminating in a lifting shackle. Provision is made for locking the clamp in grasping position and to lift the grab along its center of gravity in both opened mounting and closed grasp positions. The cylindrical object is grasped by pivoted swivel pad members mating with the cylindrical surface and mounted near the lower ends of the clamp and hook members.

8 Claims, 5 Drawing Figures

22
11
24
32
23
31
30
33
12
16
14
21
15
17
18
26
19
10
13

LIFTING GRAB FOR CYLINDRICAL OBJECTS

This invention relates to lifting grabs for engaging and moving cylindrical objects such as pipes and torpedos and more specifically it relates to grabs that may be coupled by a shackle to a hoist and vertically moved over a cylindrical object lying on a surface to engage it in a grasping action which will support the weight of the object for lifting by the hoist.

BACKGROUND

A number of problems with prior art grabs are set forth with perhaps the salient problem being that of reaching into a confined area such as a box or ditch where there is no bottom clearance and little side clearance for manipulating the grasp. Slings made of cable, chains or rope need reach underneath a raised object and have a tendency to slip and thereby endanger workers.

Grapples and grabs of the prior art are difficult to engage and may become prematurely disengaged. It is most desirable to have automatic grab engaging so that persons need not encounter the danger of handling the grab except to guide it during encounter of the cylinder and lift. Also, it is desirable to automatically lock the grasp in place and that it is not automatically unlocked when slack develops in the hoist line.

Also, many prior art grabs because of their construction are not balanced so that they are lifted along their center of gravity, nor can they be lifted in both grasping and opened positions along the center of gravity.

Many grabs such as slings require the cylindrical object to be moved for gripping or locating parts before hoisting.

Also, light weight of a grab is important for manipulating, storage and manufacture thereof, and simple construction permitting assembly and disassembly for storage, manufacture and repair is desirable.

Any grab that can slip during hoisting is dangerous.

OBJECTS OF THE INVENTION

It is therefore a general object of the invention to correct one or more of the aforesaid prior art deficiencies by providing an improved lifting grab for hoisting heavy cylindrical objects.

A more specific object of the invention is to provide a safe grab for hoisting a heavy cylindrical object that can be manipulated in confined spaces without moving the cylindrical object or providing access to its lower extremity.

Other objects of the invention are to overcome the individual aforesaid background deficiencies, and in particular to provide an automatic self-locking grab that is easily mounted to engage a cylinder for hoisting and requires manual, not automatic, releasing of the lock.

Further features, objectives and advantages of the invention will be found throughout the following specification and the accompanying drawings.

BRIEF DESCRIPTION OF THE INVENTION

A lifting grab is provided by this invention having pivoted hook and clamp members operating in a scissors like action to closely surround a cylindrical object of known dimension about an arc of greater than 180° thereby to encounter the object on its underside by pivoted pads registering with the circumferential surface, which thereby permit the grab to be lowered into place within a confined span slightly exceeding the cylinder diameter.

A self-adjusting lock in the form of a pivoted lever engaging a cam surface prevents displacement of the grab from lifting position until manual disengagement.

A lifting toggle is displaced to change the grab from a mounting to lifting mode.

THE DRAWING

THE DETAILED DESCRIPTION

Figure 1:
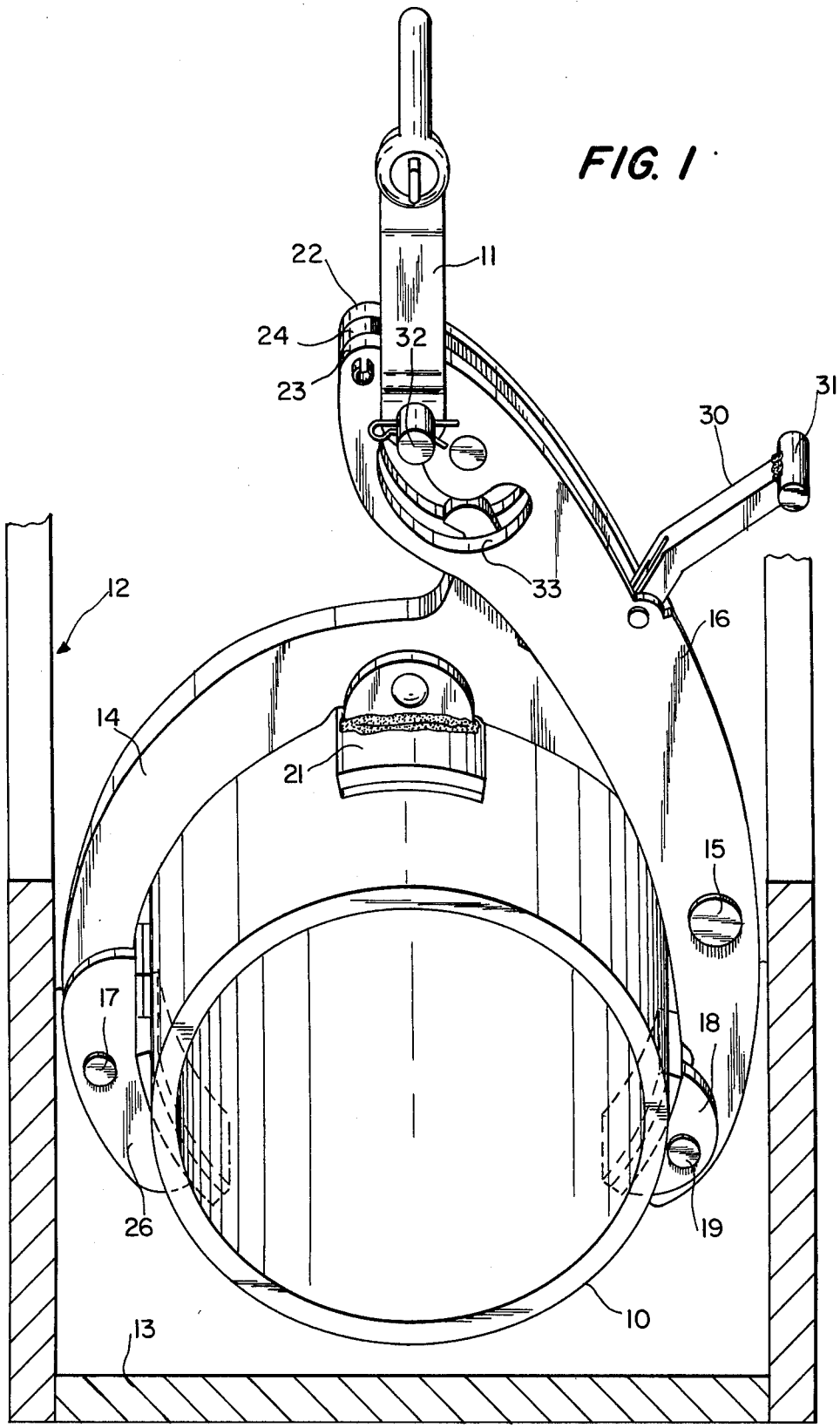
FIG. 1 is a perspective view of a preferred embodiment of the grab engaging and lifting a cylindrical object confined in a box.

Now referring to the view of FIG. 1, a preferred grab embodiment that positively clamps about a cylinder 10 as a function of hoist lifting force on shackle 11 is shown. This view demonstrates the feature of engaging and lifting the cylinder 10 within the restricted dimensions of a box 12 without the necessity of moving the cylinder. The cylinder 10 is grasped while resting on the bottom 13 of the box 12.

The grab arrangement of a few essential and simple parts is shown, where the hook member 14 is pivoted at 15 in the clamp member 16 and thereby closely encompasses the cylinder 10 about a circumferential arc of more than one quarter of the circumference of the cylinder 10. The hook member 14 has a contoured swivel pad 26 registering on the outer circumferential surface of cylinder 10 and pivoting about pin 17 near the lower end of hook member 14. This as similar swivel pad 18 pivoted at pin 19 on the lower end of clamp member 16 permits the pads to slide over the outer horizontal diameter of the cylinder 10 within the closely confined walls of box 12 when lowered vertically for mounting from a line (not shown) coupled to the shackle hitch 20. Hook member 14 is a steel plate to which the pads including a third uppermost swivel pad 21 are pivoted.

The clamp member 16 has two spaced plates 22, 23 separated by an intervening member 24. The pivot pin 15 is located through said plates 22, 23 so that hook 14 registers therebetween at a position off center nearer the lower end of clamp 16. Thus, the clap member 16 in effect continues the hook member in closely surrounding the outer circumference of the cylinder 10 to encompass together an arc greater than half the circumference of the tube 10 and thereby to permit the lower two swivel pads 26, 18 to engage the cylinder below its horizontal diameter for lifting without danger of slippage. The longer portion of clamp member 16 serves to produce clamping leverage holding swivel pads 26, 18, 21 against the cylinder 10, by means of lifting force at the shackle 11.

The grab has a pivoted lock member 30 which automatically locks the swivel pads in place in grasping position, as will be later described, until it is manually released by handle 31. No release of this lock can occur by slack in the line, only by manual release.

Also, a toggle feature is incorporated by movement between two positions of the shackle pin 32 in cam slots 33 disposed though the two clamp plates 22, 23. As shown in FIG. 1, the toggle is at the lifting end of the cam slots for grasping and lifting the grab at its center of gravity in this posture. When the shackle pin is removed to the outer end of the cam slot (by releasing lock 31 and expanding by scissor-like action the clamp and hook members when slack occurs in the hoist line), then the shackle is at the center of gravity for releasing the grab back over the cylinder 10. This center of gravity of the grab assembly changes with movement of the clamp member about pivot pin 15.

Figure 2:
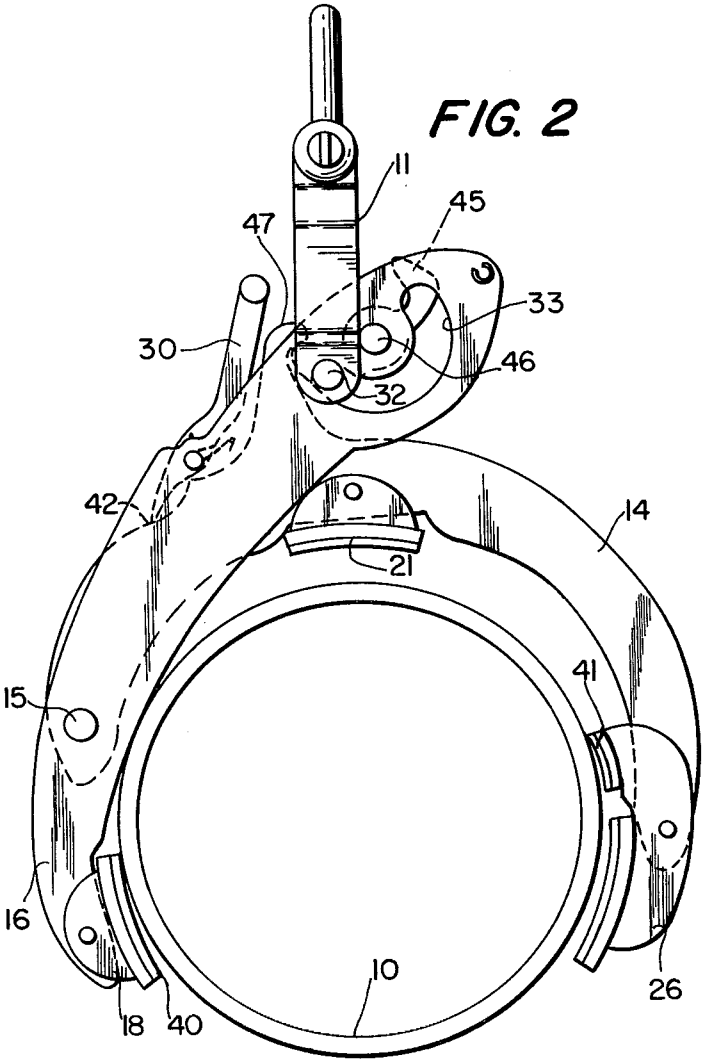
FIGS. 2 and 3 are end views of this grab respectively in mounting and lifting posture.
Figure 3:
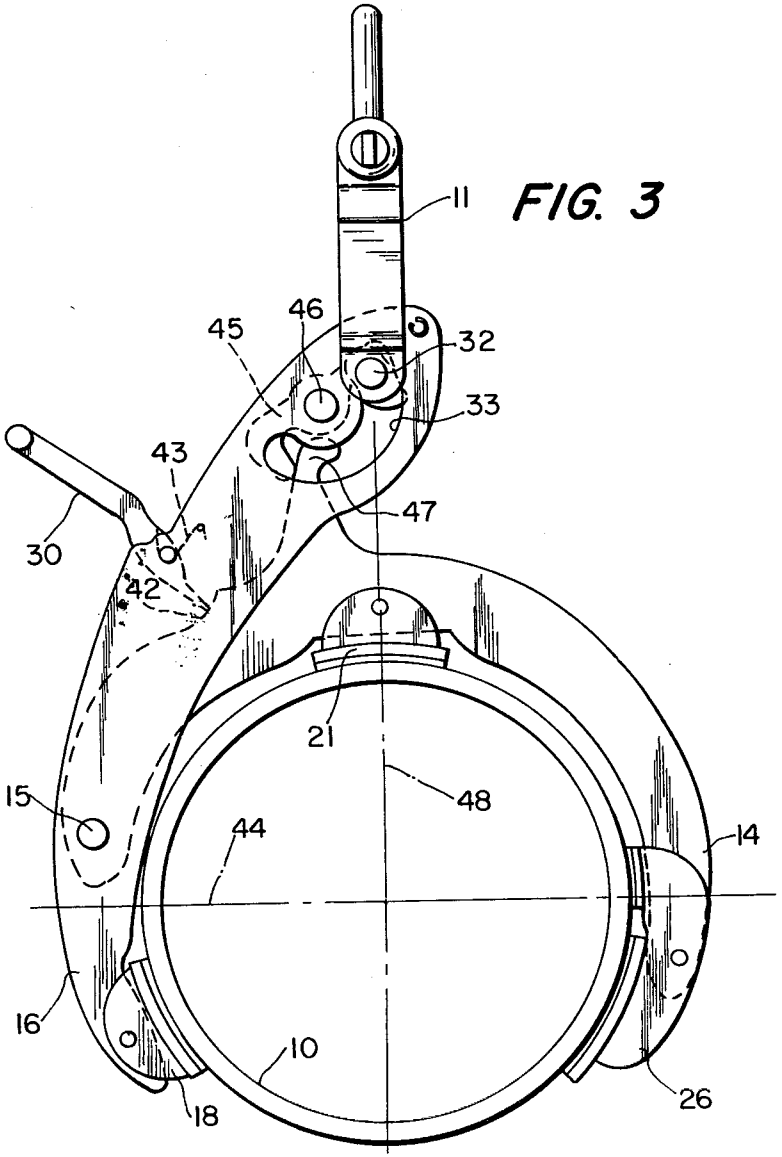

Other physical and operational features can be recognized by consideration of the end views of FIGS. 2 and 3 which respectively show the grab in mounting and lifting postures.

In FIG. 2, the shackle pin 32 is in the cam 33 toggle position for the center of gravity of the unloaded grab assembly which is being lowered over the cylinder 10. Because of the arcuate shape of cam slot 33 the shackle pin 32 will rest in the shown toggle position by the weight of the grab assembly until the pad 21 encounters the cylinder 10 and slack appears in the hoist line (not shown), whereupon the shackle pin 32 will be manually moved over to the alternate toggle position of FIG. 3 at the other end of cam slot 33. To release the grab from the FIG. 3 lifting position, the lock lever 30 must be manually moved to the FIG. 2 position and the shackle 11 and shackle pin 32 moved to the toggle position at the left hand side of cam slot 33.

As may be seen from FIGS. 2 and 3, when the swivel pads are being mounted they are in a somewhat vertical posture whereas when in lift position they are inclined toward the bottom center of the cylinder. Should they not be pivotable, then to clear the maximum cylinder diameter, the hook 14 and clamp would have to be spread farther in a scissors action and could not be used in such a narrow confined space as the box of FIG. 1, for example.

The swivel pads 18, 21, 26 may have a lining 40 of hard materials or of resilient material such as cotton webbing, rubber or neoprene. In such case the heel shoe 41 of the hook swivel pad 26 is metallic to assure that there is electrical grounding between the grab and the cyliner as the grab is mounted and the pipe is lifted.

The relationship of the lock lever 30 pivoted on clamp member 16 and its mating cam surface 42 on the hook member 14 is defined in the two extreme positions in FIGS. 2 and 3. It is noted that the spring 43 rotates lock lever 30 counterclockwise as pads 18, 26 are scissored together below the horizontal diameter 44 of cylinder 10 for lifting in the FIG. 3 position, to thereby slide along cam surface 42 into a self-locking position. The lock lever 30 can be released then to respread the pivot pads 18, 26 after the lift for removal of the grab by clockwise manual rotation against the bias of spring 43.

Further aiding the scissors action to clamp the cylinder 10 tightly is the toggle cam 45 as shown in FIG. 3 where the hoist force pivots it about pin 46 to bear upon tongue 47 holding the grab tightly scissored against the cylinder 10 during the lifting operation, which cannot retract or loosen until lock lever 30 is manually released. Thus, a fail-safe no-slip lifting action is provided.

The same toggle cam 45 serves to release the grab as shown in FIG. 2, by rotating to press tongue 47 leftwardly as the shackle pin 32 is moved to the leftmost position in cam slot 33. Then the hoist line will serve to open scissors-like the swivel pads 18, 26 to an optimum spread distance just clearing the predetermined outer diameter of cylinder 10. Thus, toggle cam 45 provides both a positive clasping and unclasping action by means of the vertical hoist force applied to shackle 11, which for a heavy weight of loaded cylinder 10 assures a good grasp and for the unloaded weight of only the grab assembly is enough force to remove the grab gently without movement or displacement of the cylinder 10.

Figure 4:
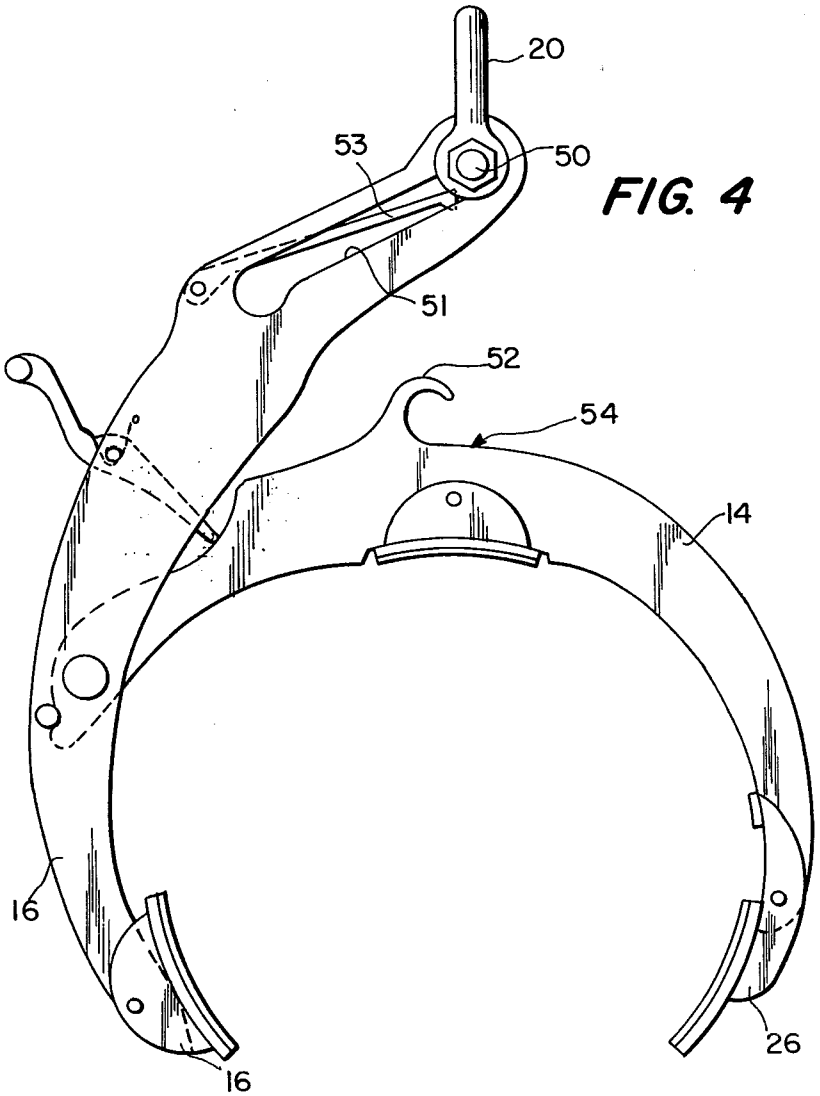

A simplified mechanism without the toggle cam is shown in FIG. 4. The clasping and locking is accomplished in the same way and only the toggle action is changed. Thus, a hoist eye 20 has a pin 50 riding in cam slot 51 on the clamp member 16. The pin 50 may be held in the outer end of the cam slot 51 by means of pivoted detent 53 which is automatically operable. Thus, it may be rotated counter-clockwise by the lifting action of eye 52 to permit the pin 50 to pass to the other end of cam slot 51.

As shown the grab is in the clasping position for lifting a cylinder by scissoring pads 18, 26 together and the hoist line will pull vertically along the center of gravity of the grab in that posture in substantially the same manner as in FIG. 3 along the vertical diameter center line 48.

When the lock lever 30 in FIG. 4 is released after slack occurs in the hoist line, hook 14 is sissored into clamp 16, and the pressure created by eye 52 rotates the detent 53 upward, permitting pin 50 to be moved into registry underneath hooked tongue 52 for lifting the unloaded grab along its center of gravity with pads 16, 28 spread to clear the cylinder (not shown).

Figure 5:
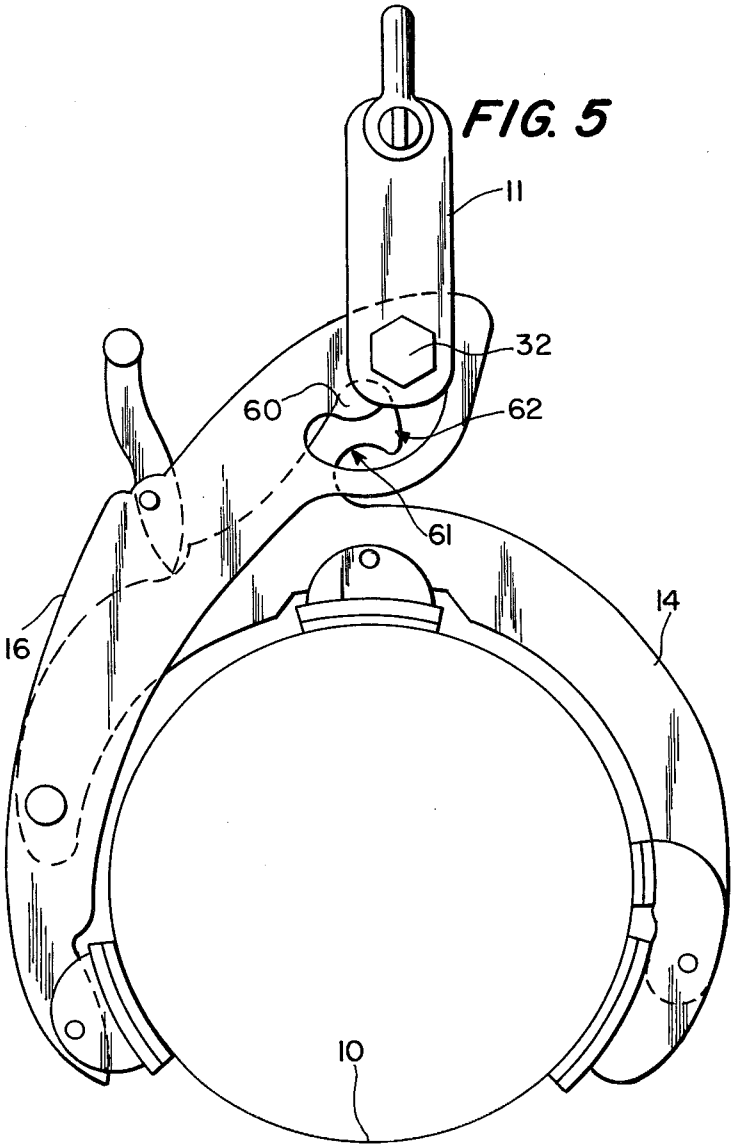
FIGS. 4 and 5 are end views of other simplified embodiments of a grab assembly constructed in accordance with the teachings of this invention.

The further embodiment of FIG. 5 operates similarly and its configuration is substantially the same as the FIGS. 1 to 3 embodiment except the tongue 60 has hook 61 for receiving the shackle pin 32 in the manner described for FIG. 4. Surface 62 of tongue 60 acts as a detent for shackle pin 32.

It is therefore clear that this invention has provided an improved grab assembly offering several advantageous features. Those novel features believed to represent the spirit and nature of the invention are set forth with particularlity in the appended claims.

What is claimed is:

1. A lifting grab for cylindrical objects comprising in combination, a hook member for surrounding closely about a circumferential arc an angle of more than one-quarter of the circumference of said cylindrical object of a predetermined diameter, a clamp member pivoted off center at a pivot position near one end of the hook member with a shorter portion continuing from said hook member closely about the circumference of said cylindrical objects therewith together to encompass closely about said cylindrical objects a grasping circumferential arc of more than half its circumferential span and with a longer portion extending to an extremity lifting portion substantially located on a vertical diameter through an encompassed said cylindrical object which substantially bisects said grasping arc, a set of at least two cylinder grasping pads pivoted at pad pivot positions near the respective ends of said hook and clamp members when placed in said grasping arc and having a facing curvature substantially conforming to the outer circumference of said cylindrical objects whereby the pads pivot on the ends of said clamp and hook members when the clamp and hook members are lowered vertically over the horizontal diameter of said cylindrical object thereby to maintain said clamp and hook members at a closer distance away from the circumference of the cylindrical object than possible with stationary pads, and whereby when said clamp member is lifted vertically by said lifting portion the pads pivot about their said pivot positions and the clamp member pivots at its pivot position thereby causing said pads to grasp said cylindrical object below a horizontal diameter thereof, a cam slot in said clamp member near said extremity lifting portion, a shackle coupled to said cam slot to move therein over a range of at least two positions wherein said clamp member comprises a pair of spaced plate members each with a registering said cam slot, said shackle is coupled by a shackle pin extending through both plates, a tongue member extending from said hook member to engage and hold shackle pin when said lifting grab is in an open position just clearing the diameter of said cylindrical object with said pads, wherein the hook member is located at substantially a line on the center of gravity of said clamp member thereby to permit vertical movement down over said cylindrical object without force or movement thereof, wherein said tongue member comprises a C-shaped hook into which the shackle pin may be inserted and removed by movement within said cam slot.

2. A lifting grab as defined in claim 1 including detent means for holding said shackle pin releasably in position at the remote end of said cam slot near the end of the tongue member on a line near the center of gravity of said lifting grab when said pads are in position grasping said cylindrical object.

3. A lifting grab for cylindrical objects comprising in combination, a hook member for surrounding closely about a circumferential arc an angle of more than one-quarter of the circumference of said cylindrical object of a predetermined diameter, a clamp member pivoted off center at a pivot position near one end of the hook member with a shorter portion continuing from said hook member closely about the circumference of said cylindrical objects therewith together to encompass closely about said cylindrical objects a grasping circumferential arc of more than half its circumferential span and with a longer portion extending to an extremity lifting portion substantially located on a vertical diameter through an encompassed said cylindrical object which substantially bisects said grasping arc, a set of at least two cylinder grasping pads pivoted at pad pivot positions near the respective ends of said hook and clamp members when placed in said grasping arc and having a facing curvature substantially conforming to the outer circumference of said cylindrical objects whereby the pads pivot on the ends of said clamp and hook members when the clamp and hook members are lowered vertically over the horizontal diameter of said cylindrical object thereby to maintain said clamp and hook members at a closer distance away from the circumference of the cylindrical object than possible with stationary pads, and whereby when said clamp member is lifted vertically by said lifting portion the pads pivot about their said pivot positions and the clamp member pivots at its pivot position thereby causing said pads to grasp said cylindrical object below a horizontal diameter thereof, a cam slot in said clamp member near said extremity lifting portion, a shackle coupled to said cam slot to move therein over a range of at least two positions wherein said clamp member comprises a pair of spaced plate members each with a registering said cam slot, said shackle is coupled by a shackle pin extending through both plates, wherein said hook member has a projecting arm fitting between said two plates to extend into the region between the two cam slots in said spaced plate members, and including a rotary cam member pivoted adjacent said cam slots between said two plates with one end pivoted on said shackle pin and the other end movable into camming contact with said projecting arm thereby to urge said pads against the circumference of said cylindrical object by force of lifting force on said shackle.

4. A lifting grab as defined in claim 3 including a swivel pad shaped and positioned on said hook member to engage said cylindrical object at its uppermost circumferential extremity.

5. A lifting grab as defined in claim 3 including resilient surfaces on said grasping pads where they encounter the outer circumference of said cylindrical object.

6. A lifting grab as defined in claim 5, wherein the upper end of the pad on said hook member is metallic and grounded to the grab thereby to assure grounded contact with the cylindrical object.

7. A lifting grab as defined in claim 3, wherein the lifting pad on said hook member encompasses a greater arc about the circumference of said cylindrical object than the lifting pad on said clamp member.

8. A lifting grab as defined in claim 3 including a toggle cam displaceable between two positions, one for keeping the clamp and hook members separated by means of the grab weight and the other for keeping the clamp and hook members in grasping position by lifting force at said lifting portion.

* * * * *